US009823006B2

(12) United States Patent
Kim

(10) Patent No.: US 9,823,006 B2
(45) Date of Patent: Nov. 21, 2017

(54) ICE MAKER AND METHOD OF CONTROLLING THE SAME

(71) Applicant: COWAY CO., LTD, Chungcheongnam-do (KR)

(72) Inventor: Se-Joo Kim, Seoul (KR)

(73) Assignee: Conway Co., Ltd (KR)

( * ) Notice: Subject to any disclaimer, the term of this patent is extended or adjusted under 35 U.S.C. 154(b) by 0 days.

(21) Appl. No.: 15/351,108

(22) Filed: Nov. 14, 2016

(65) Prior Publication Data

US 2017/0115044 A1 Apr. 27, 2017

Related U.S. Application Data

(62) Division of application No. 13/499,413, filed as application No. PCT/KR2009/007979 on Dec. 30, 2009, now Pat. No. 9,528,738.

(30) Foreign Application Priority Data

Sep. 30, 2009 (KR) ..... 10-2009-0093479
Dec. 14, 2009 (KR) ..... 10-2009-0123819

(51) Int. Cl.
*A23G 9/00* (2006.01)
*F25C 1/18* (2006.01)
(Continued)

(52) U.S. Cl.
CPC ..... *F25C 1/18* (2013.01); *F25C 1/08* (2013.01); *F25C 1/20* (2013.01); *F25C 1/225* (2013.01);
(Continued)

(58) Field of Classification Search
CPC ..... F25C 1/00; F25C 1/18; F25C 1/20; F25C 5/08; F25C 1/08; F25C 1/10
See application file for complete search history.

(56) References Cited

U.S. PATENT DOCUMENTS 4,199,956 A 4/1980 Lunde
6,647,739 B1 11/2003 Kim et al.
(Continued)

FOREIGN PATENT DOCUMENTS

CN 1461928 12/2003
EP 0 580 951 2/1994
(Continued)

OTHER PUBLICATIONS

Translation of JP2007285603.*
(Continued)

*Primary Examiner* — Elizabeth Martin
(74) *Attorney, Agent, or Firm* — The Farrell Law Firm, P.C.

(57) ABSTRACT

The disclosure includes a water tray member receiving raw water for ice-making from a water tank, an ice making unit cooling the raw water received in the water tray member and forming ice, a heating unit heating the raw water received in the water tray member, and a control unit controlling an operation of the heating unit such that the raw water received in the water tray member is heated before the ice making unit cools the raw water in the water tray member. According to the ice maker, the temperature of the raw water received in an ice-making water tray is raised to a preset temperature at the initial stage of an ice making process, thereby preventing the formation of an opaque layer in the central portion of ice.

9 Claims, 7 Drawing Sheets

(51) Int. Cl.
*F25C 1/22* (2006.01)
*F25C 1/08* (2006.01)
*F25C 1/20* (2006.01)

(52) U.S. Cl.
CPC ..... *F25C 2600/04* (2013.01); *F25C 2700/14* (2013.01)

(56) References Cited

U.S. PATENT DOCUMENTS

| | | | | |
|---|---|---|---|---|
| 2004/0025527 | A1 | 2/2004 | Takahashi et al. | |
| 2005/0072166 | A1* | 4/2005 | Lee | F25C 1/04 62/135 |
| 2009/0049858 | A1 | 2/2009 | Lee et al. | |
| 2011/0209483 | A1 | 9/2011 | Hall et al. | |

FOREIGN PATENT DOCUMENTS

| | | |
|---|---|---|
| JP | 05001870 | 1/1993 |
| JP | 6-4561 | 1/1994 |
| JP | 06221736 | 8/1994 |
| JP | 2001041623 | 2/2001 |
| JP | 2003042615 | 2/2003 |
| JP | 2007-285603 | 11/2007 |
| KR | 100272894 | 11/2000 |
| KR | 1020050105819 | 11/2005 |
| KR | 1020060060449 | 6/2006 |
| WO | WO 2009/078562 | 6/2009 |

OTHER PUBLICATIONS

PCT/ISA/237 Written Opinion issued on PCT/KR2009/007979 (pp. 5)
PCT/ISA/210 Search Report issued on PCT/KR2009/007979 (pp. 3).
European Search Report dated Aug. 10, 2016 issued in counterpart application No. 09850114.1-1605, 9 pages.

* cited by examiner

【Figure 1】
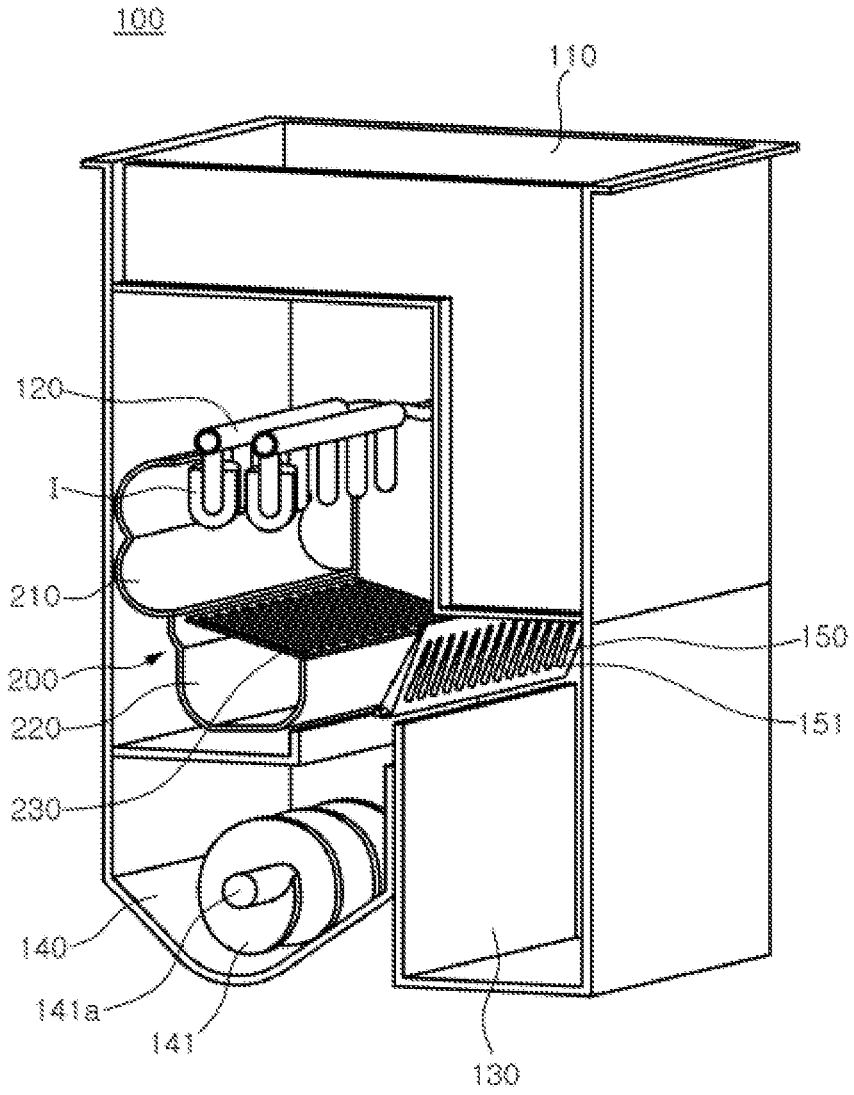

【Figure 2】
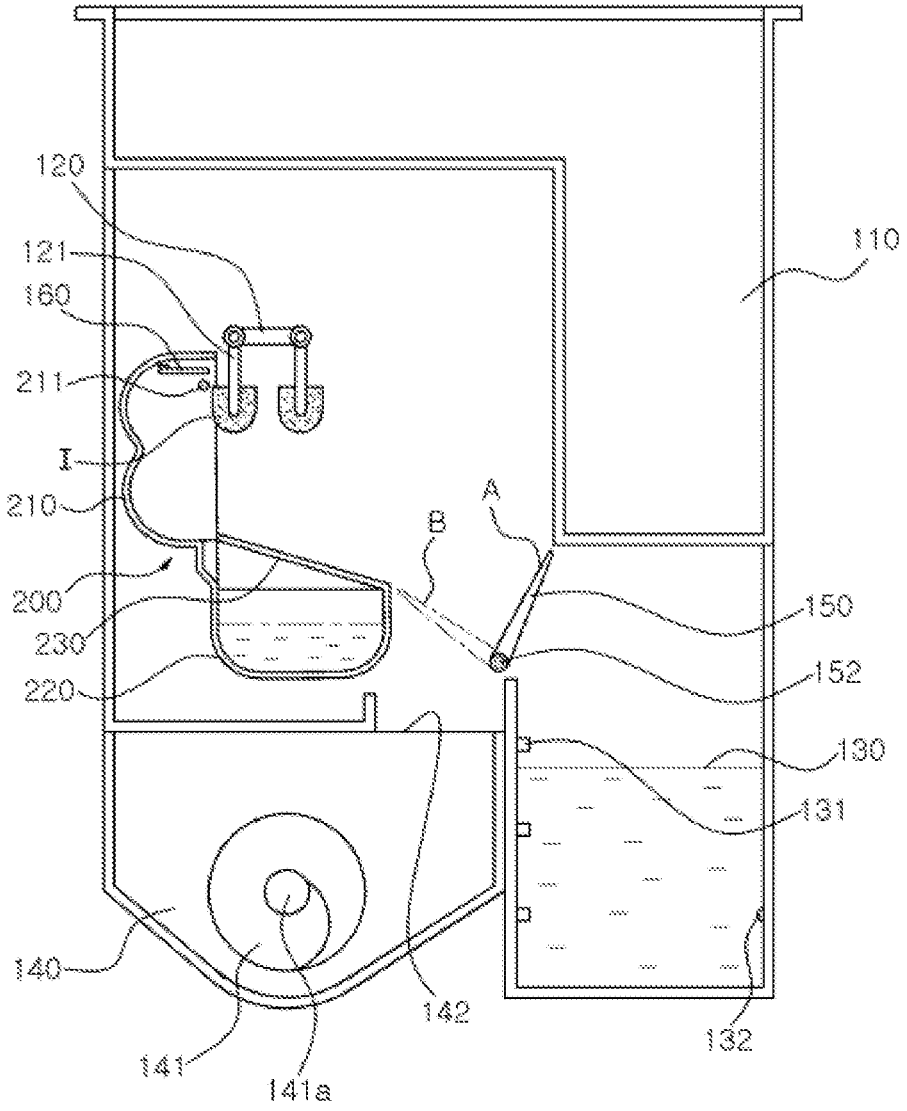

【Figure 3】
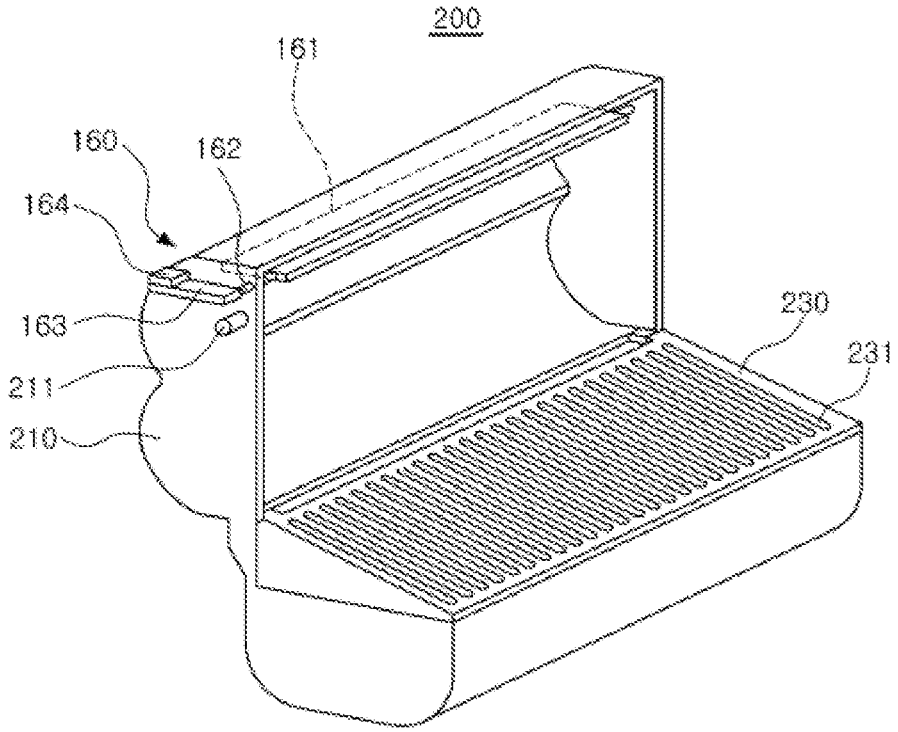
【Figure 4】
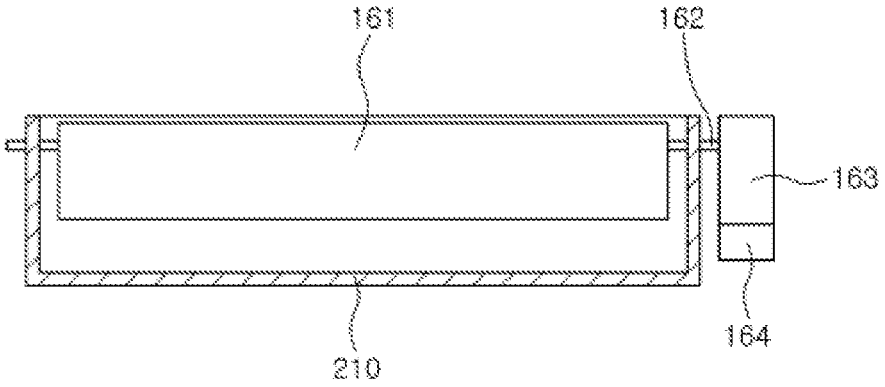

【Figure 5】
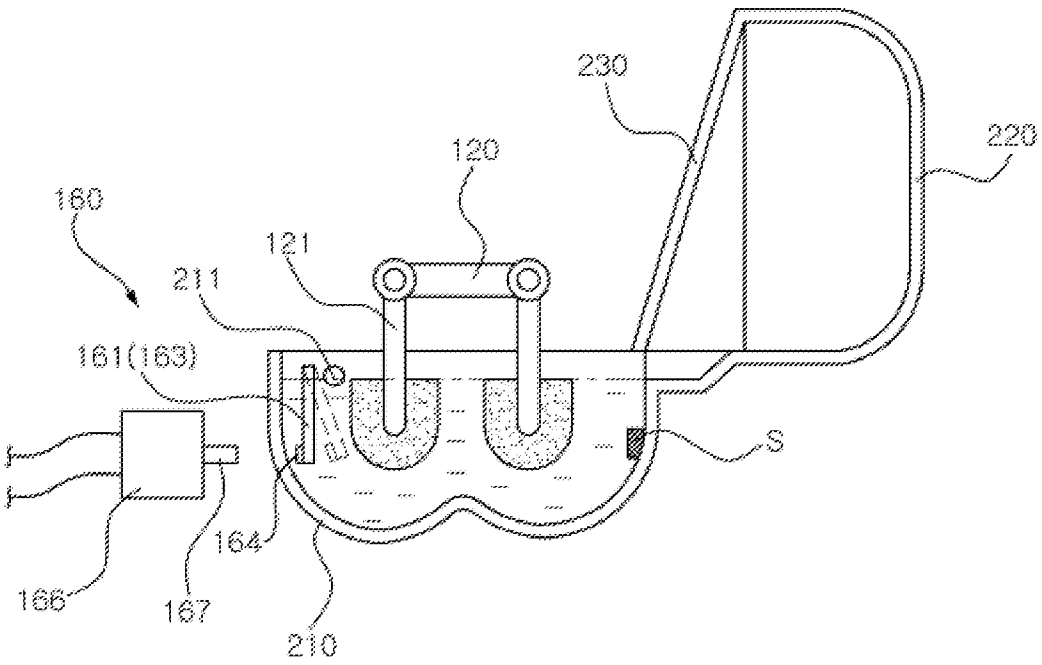

【Figure 6】
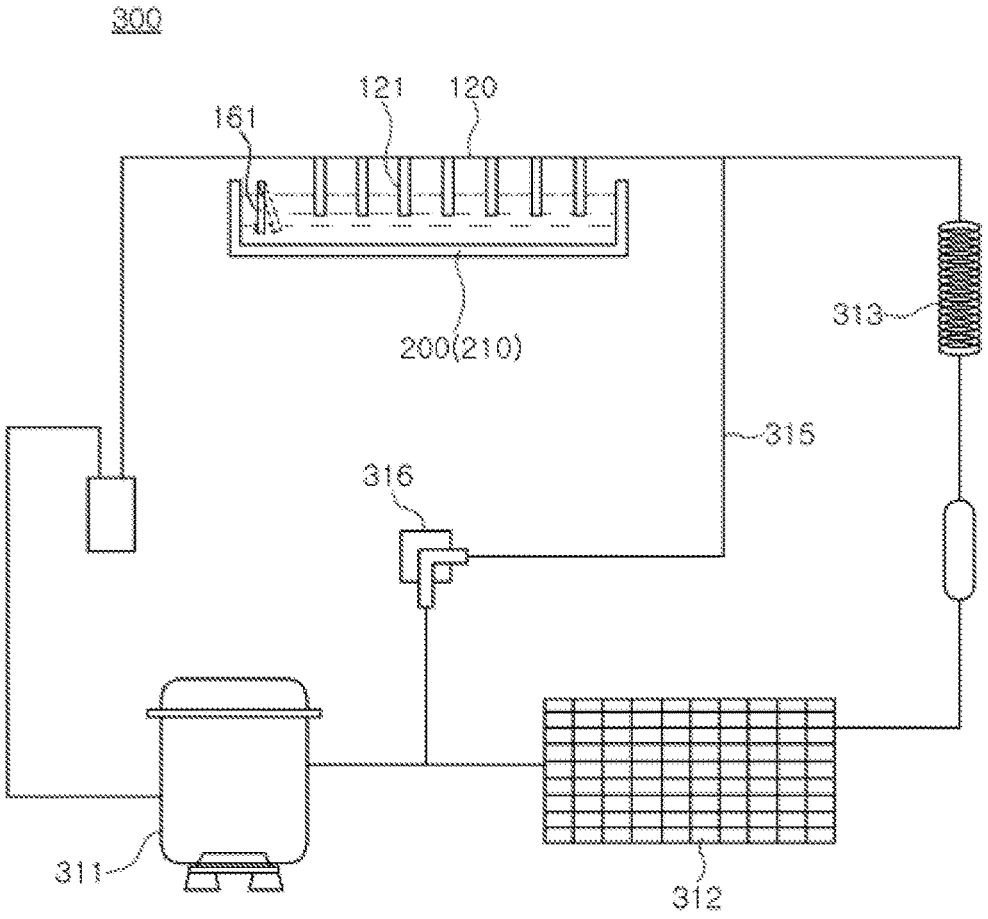

【Figure 8】
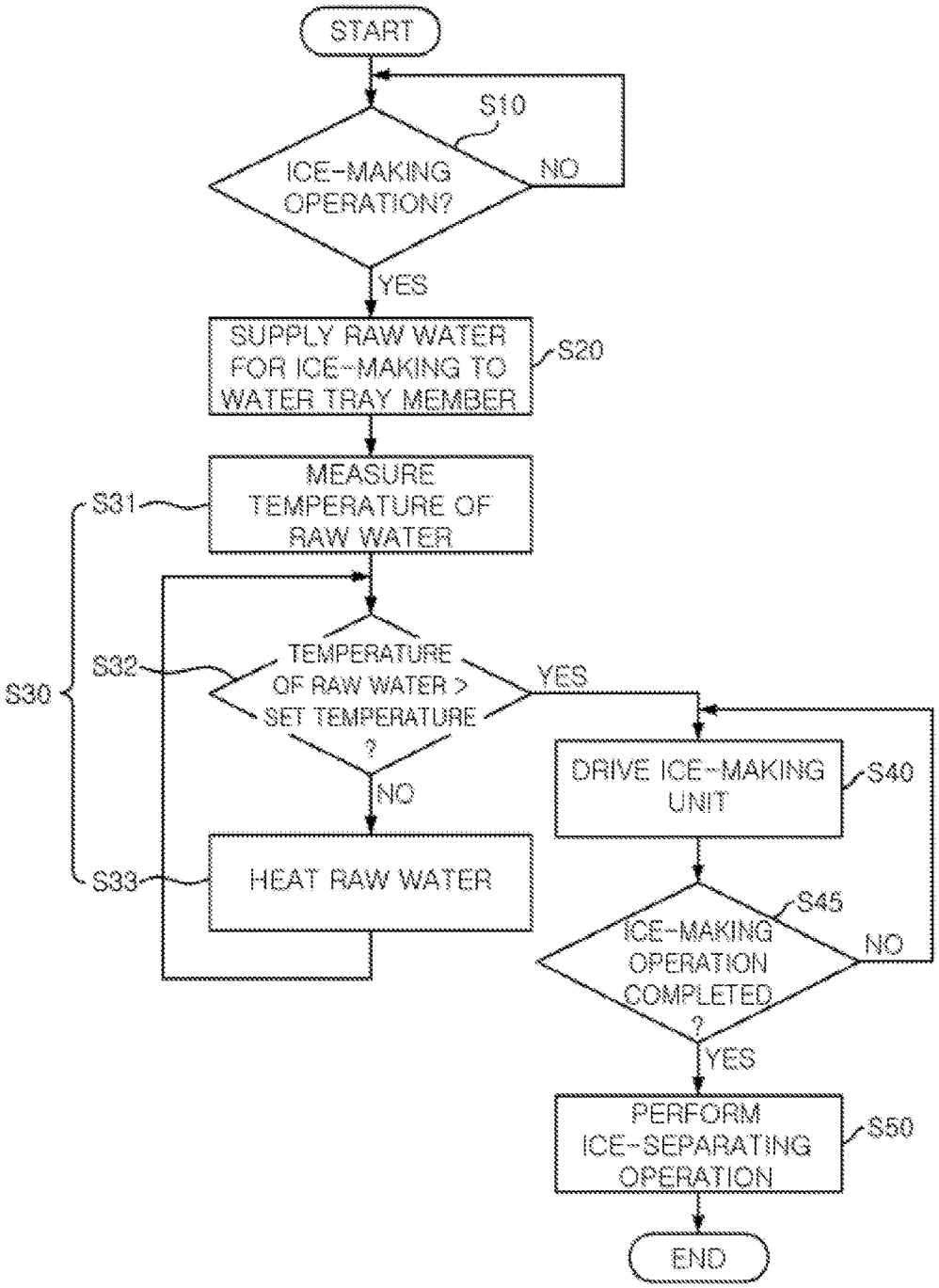

ICE MAKER AND METHOD OF CONTROLLING THE SAME

PRIORITY

This application is a Divisional Application of U.S. patent application Ser. No. 13/499,413 which was filed in the U.S. Patent and Trademark Office on Mar. 30, 2012, as a National Phase Entry of PCT International Application No. PCT/KR2009/007979 filed Dec. 30, 2009, and claims priority to Korean Patent Application No. 10-2009-0093479 filed with the Korean Intellectual Property Office on Sep. 30, 2009, and to Korean Patent Application No. 10-2009-0123819 filed with the Korean Intellectual Property Office on Dec. 14, 2009, the contents of each of which is incorporated herein by reference.

BACKGROUND

1. Field of the Invention

The present invention relates to an ice maker capable of producing ice and a method of controlling the same, and more particularly, to an ice maker capable of producing clear ice, and a method of controlling the same.

2. Description of the Related Art

In general, an ice water purifier is a device that purifies raw water such as tap water and provides a user not only with purified cold and/or hot water, but also with ice by freezing purified water (or cold water). The ice water purifier typically includes a filter that purifies raw water, a purified water tank that stores purified water, a water cooler tank that cools and stores purified water, and an ice making unit that produces ice. The ice water tank may further include a water heater tank that heats and stores purified water.

This ice water purifier has a similar configuration to a typical ice maker except that the ice water purifier includes water tanks such as a water cooler tank or a water heating unit tank. Thus, the ice water purifier may be understood as a unique type of ice maker.

Hereinafter, an ice maker will be described using an ice water purifier as an example.

In order to produce ice using an ice maker, a spraying method and an immersion method may be used among known ice-making methods. As for the spraying method such as nozzle spraying or cell spraying, water is sprayed onto a cooled ice-making water tray using a spray pump and is grown into cup-shaped or bell-shaped ice pieces. As for the immersion method, water is supplied to an ice-making water tray, and an immersion pipe of an evaporator is then cooled such that bell-shaped ice pieces with holes in their centers are produced. A spray-type ice making unit is capable of producing clear ice but is relatively expensive, whereas an immersion-type ice making unit is cheaper but is disadvantageous in that air bubbles are trapped in ice, causing the ice to have an opaque appearance. For this reason, typical ice water purifiers employ the immersion type ice making unit which is relatively economical and simple in structure, and easily produces ice.

In the immersion type ice making unit, an immersion pipe, connected to an evaporator, is immersed in water received in a water tray member, and ice is formed around the immersion pipe.

However, when raw water for ice-making received in the water tray member is low in temperature, ice may rapidly grow around the immersion pipe at the initial stage of an ice making process due to the low temperature of a refrigerant introduced into the evaporator, and this may cause air bubbles to be trapped in that area, thereby creating an opaque layer.

In particular, the opacity of ice formed around the immersion pipe is increased when the temperature of raw water for ice-making is low (e.g., lower than 5° C.) as in the case that cold water is supplied to a water tray member or raw water, remaining after the termination of an ice making process, is re-used in the next ice making process.

Since an opaque layer is formed in the ice at the initial stage of the ice making process, the transparency of the ice is lowered even if air bubbles are prevented, thereby impairing the quality of ice.

Furthermore, a related art ice maker provided with the immersion type ice making unit has a complicated bubble prevention structure which is difficult to control.

SUMMARY

An aspect of the present invention provides an ice maker capable of preventing the formation of an opaque layer in the central portion of ice, and a method of controlling the same.

An aspect of the present invention also provides an ice maker capable of generating clear ice by preventing air bubbles from being trapped not only in the central portion of the ice but also in the edge portion thereof, and a method of controlling the same.

An aspect of the present invention also provides an ice maker having a simple bubble prevention structure which is easy to install and control and can prevent air bubbles from being trapped in ice, and a method of controlling the same.

An aspect of the present invention also provides an ice maker capable of efficiently increasing the temperature of raw water for ice-making, and a method of controlling the same.

According to an aspect of the present invention, there is provided an ice maker including: a water tray member receiving raw water for ice-making from a water tank; an ice making unit cooling the raw water received in the water tray member and forming ice; a heating unit heating the raw water received in the water tray member; and a control unit controlling an operation of the heating unit such that the raw water received in the water tray member is heated before the ice making unit cools the raw water in the water tray member.

The ice making unit may include an evaporator having an immersion pipe immersed in the raw water received in the water tray member. The control unit may supply a low-temperature refrigerant to the evaporator so as to form ice around the immersion pipe.

The heating unit may include a solenoid valve provided integrally in the ice making unit and supplying a high-temperature refrigerant to the evaporator. Alternatively, the heating unit may include a heater provided separately from the ice making unit and heating the raw water received in the water tray member.

The heating unit may be configured to heat the raw water while being immersed in the raw water.

The ice maker may further include a movement generation unit generating a movement of the raw water received in the water tray member.

According to another aspect of the present invention, there is provided an ice maker including: a water tray member receiving raw water for ice-making from a water tank; an ice making unit including an evaporator having an immersion pipe immersed in the raw water received in the water tray member, the ice making unit supplying a low-temperature or high-temperature refrigerant to the evaporator so as to form ice around the immersion pipe or separate ice from the immersion pipe; a movement generation unit generating a movement of the raw water received in the water tray member; and a control unit controlling an operation of the ice making unit such that a temperature of the raw water received in the water tray member is raised by supplying the high-temperature refrigerant to the evaporator before ice is formed around the immersion pipe.

The movement generation unit may include a wave generation plate immersed in the raw water in the water tray member and swiveled within a predetermined angular range.

The movement generation unit may include: the wave generation plate; a permanent magnet installed at one side of the wave generation plate; and an electromagnet periodically applying an attractive force or a repulsive force to the permanent magnet.

The permanent magnet may be installed outside the water tray member, and be fixed to a fixing member swiveled together with the wave generation plate.

The water tray member may include: an ice-making water tray receiving the raw water in which the immersion pipe is immersed in an ice making process; and an auxiliary water tray connected to the ice-making water tray and receiving the raw water remaining in the ice-making water tray in an ice separating process.

The ice maker may further include a temperature sensor measuring a temperature of the raw water received in the water tray member. The control unit may control an operation of the heating unit according to a temperature detected by the temperature sensor.

According to another aspect of the invention, there is provided a method of controlling an ice maker that produces ice by cooling raw water for ice-making received in a water tray member, the method including: supplying raw water for ice-making to the water tray member; raising a temperature of the raw water received in the water tray member; forming ice by cooling the raw water, having a temperature raised in the raising of the temperature of the raw water, by using an ice making unit; and separating the ice formed in the forming of the ice.

The ice making unit may include an evaporator connected with an immersion pipe immersed in the raw water received in the water tray member. In the forming of the ice, the ice may be formed around the immersion pipe while the immersion pipe is immersed in the raw water in the water tray member.

The forming of the ice may include moving the raw water received in the water tray member.

The moving of the raw water may be performed by swiveling a wave generation plate, immersed in the raw water in the water tray member, within a predetermined angular range. Preferably, the wave generation plate may be swiveled by a magnetic force.

Alternatively, the moving of the raw water may be performed by rotating the water tray member within a predetermined angular range, or by vibrating the raw water received in the water tray member.

The water tray member may include: an ice-making water tray receiving the raw water in which the immersion pipe is immersed in the forming of the ice; and an auxiliary water tray receiving the raw water remaining in the ice-making water tray in the separating of the ice. The supplying of the raw water may be performed by providing the ice-making water tray with the raw water, remaining in the auxiliary water tray, and raw water for ice-making, newly provided from a water tank.

In the raising of the temperature, the temperature of the raw water received in the water tray member may be raised by supplying a high-temperature refrigerant to the evaporator or by using a heater contacting the evaporator.

The raising of the temperature may be performed by heating the raw water received in the water tray member by using a heating unit immersed in the raw water.

In the raising of the temperature, the temperature of the raw water received in the water tray member may be raised to a set temperature or higher, the set temperature ranging from 6° C. to 25° C. Preferably, the set temperature may range from 10° C. to 15° C.

The raising of the temperature may be performed simultaneously during or after the supplying of the raw water.

The raising of the temperature and the forming of the ice may be performed at room temperature.

According to an exemplary embodiment of the present invention, the formation of an opaque layer in the central portion of ice can be prevented by raising the temperature of raw water for ice-making, received in an ice-making water tray, at the initial stage of an ice making process.

In addition, according to an exemplary embodiment of the present invention, raw water for ice-making is moved during an ice-making process, so that air bubbles are prevented from being trapped in ice and wholly clear ice can be produced.

Furthermore, according to an exemplary embodiment of the present invention, movements (waves) are generated by using a permanent magnet and an electromagnet. Thus, the introduction of air bubbles in ice can be prevented by using a simple structure. Also, the use of the electromagnet simplifies the installation structure thereof.

In addition, according to an exemplary embodiment of the present invention, since the permanent magnet is installed outside a water tray member, ice contamination caused by the rust of the permanent magnet is prevented, thereby maintaining cleanliness.

According to an exemplary embodiment, a heated immersion pipe or a heater is immersed in raw water for ice-making, thereby efficiently raising the temperature of the raw water for ice-making.

BRIEF DESCRIPTION OF THE DRAWINGS

FIG. 1 is a perspective view, with a cut-out portion, illustrating an ice maker according to an exemplary embodiment of the present invention.

FIG. 2 is a schematic view illustrating the internal structure of the ice maker depicted in FIG. 1.

FIG. 3 is a perspective view illustrating water tray member mounted with a movement generation unit in the ice maker depicted in FIG. 1.

FIG. 4 is a cross-sectional view illustrating the water tray member and the movement generation unit depicted in FIG. 3.

FIG. 5 is a schematic view illustrating the operation of the movement generation unit according to an exemplary embodiment of the present invention.

FIG. 6 is a schematic view illustrating an immersion-type ice making unit of the ice maker according to an exemplary embodiment of the present invention.

FIG. 8 is a flowchart illustrating a method of controlling an ice maker according to an exemplary embodiment of the present invention.

DETAILED DESCRIPTION

Figure 7A:
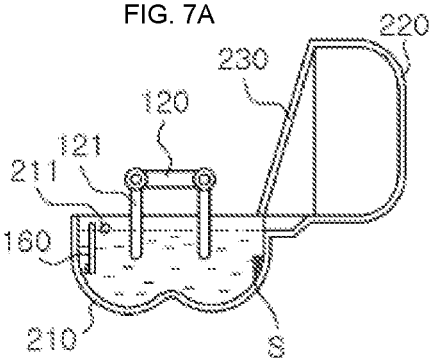
FIGS. 7A through 7F are schematic views illustrating a method of driving an ice maker according to an exemplary embodiment of the present invention.

Hereinafter, exemplary embodiments of the present invention will be described in detail with reference to accompanying drawings.

FIG. 1 is a perspective view, with a cut-out portion, illustrating an ice maker according to an exemplary embodiment of the present invention. FIG. 2 is a schematic view illustrating the internal structure of the ice maker depicted in FIG. 1. FIG. 3 is a perspective view illustrating water tray member mounted with a movement generation unit in the ice maker depicted in FIG. 1. FIG. 4 is a cross-sectional view illustrating the water tray member and the movement generation unit depicted in FIG. 3. FIG. 5 is a schematic view illustrating the operation of the movement generation unit according to an exemplary embodiment of the present invention. FIG. 6 is a schematic view illustrating an immersion-type ice making unit of the ice maker according to an exemplary embodiment of the present invention. FIGS. 7A through 7F are schematic views illustrating a method of driving an ice maker according to an exemplary embodiment of the present invention. FIG. 8 is a flowchart illustrating a method of controlling an ice maker according to an exemplary embodiment of the present invention.

An ice maker, according to an exemplary embodiment of the present invention, will now be described with reference to FIGS. 1 through 7F. In general, an ice water purifier has a similar configuration to a typical ice maker, except that the ice water purifier includes a water cooler tank and a water heater tank. Thus, the ice water purifier may be understood to be a unique type of ice maker. Accordingly, the ice maker will be described by using an ice water purifier an example.

As shown in FIGS. 1 and 2, an ice maker 100 includes a water tray member 200 receiving raw water for ice-making (hereinafter raw water), an ice making unit 300 (see FIG. 6) cooling the raw water received in the water tray member 200 and forming ice, a heating unit heating the raw water received in the water tray member 200, and a control unit (not shown) controlling the operation of the heating unit such that the raw water in the water tray member 200 is heated before the ice making unit 300 cools the raw water in the water tray member 200. The ice maker 100 may further include a movement generation unit 160 generating a movement of the raw water received in the water tray member 200.

Referring to FIG. 6, the ice making unit 300 includes an evaporator 120 having immersion pipes 121 immersed in the raw water received in the water tray member 200. The control unit may supply a low-temperature refrigerant to the evaporator 120 so that ice is formed around the immersion pipes 121.

Like a typical ice water purifier, the ice maker 100, according to this embodiment, may include a purified water tank 110 storing purified water, having filtered through a filter (not shown), at room temperature, an ice storage unit 140 storing ice I generated by the ice making unit 300 (see FIG. 6), a water cooler tank 130 cooling water received therein by using the ice I produced by the ice making unit 300, and a guide member 150 guiding the ice I, generated by the ice making unit 300, to be provided selectively to the ice storage unit 140 or to the water cooler tank 10.

Referring to FIG. 2, when the guide member 150 is placed at location A, ice may be dropped into the ice storage unit 140 through an opening 142. In contrast, when the guide member 150 is placed at location B by being rotated about a shaft 152, ice may be dropped into the water cooler tank 130 so as to lower the temperature of cold water received in the water cooler tank 130. As shown in FIG. 2, a water level sensor 131 and a temperature sensor 132 may be mounted inside the water cooler tank 130.

As shown in FIGS. 1 and 2, the ice storage unit 140 is placed at a lower level than the water tray member 200 so that the ice storage unit 140 can receive ice separated from the immersion pipes 121 of the evaporator 120. An ice discharge unit 141, such as a screw, may be installed in the ice storage unit 140 for the purpose of ice extraction. When the ice discharge unit 141 is rotated forwardly about a rotary shaft 141*a* by the operation of a driving motor (not shown), ice loaded in the ice storage unit 140 is discharged through an ice spout (not shown).

The configuration of the water tray member 200 of the ice maker 100, according to this embodiment, will now be described in greater detail with reference to FIGS. 1 through 7F.

The water tray member 200 may include an ice-making water tray 210 and an auxiliary water tray 220. The ice-making water tray 210 receives raw water from a water tank such as the water cooler tank 130 or the purified water tank 110 such that ice is produced by the immersion type ice making unit 300 (see FIG. 6). The auxiliary water tray 220 is connected to the ice-making water tray 210 and receives the raw water remaining in the ice-making water tray 210 when the ice-making water tray 210 is emptied after the immersion type ice making unit 300 produces ice I by cooling the raw water.

Figure 7B:
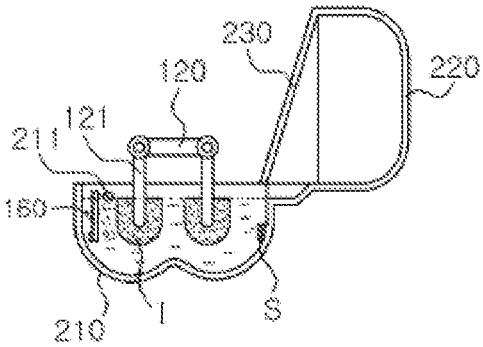

The ice-making water tray 210 has a receiving space of a predetermined size so as to receive raw water at the ice-making location thereof illustrated in FIGS. 7A and 7B. In addition, the auxiliary water tray 220 is connected to one side of the ice-making water tray 210 and may be configured such that raw water remaining in the ice-making water tray 210 is moved and received therein in the process of emptying the ice-making water tray 210 after cooling the raw water.

A guide grill 230 may be installed at the upper portion of the auxiliary water tray 220. Referring to FIG. 3, the guide grill 230 makes ice to be dropped into the ice storage unit 140 or the water cooler tank 130. At the same time, the guide grill 230 causes raw water remaining in the ice-making water tray 210 to flow into the auxiliary water tray 220 through a water inlet 230 during an ice separating process, which is the process of emptying the ice-making water tray 210.

However, the water tray member 200 is not limited to the above-described configuration, provided that it includes the immersion pipe 121 and thus can produce ice. For example, the water tray member 200 may be configured as a single water tray that is rotated or translated between ice-making and ice-separating locations.

Thereafter, the configuration of the immersion type ice making unit 300 will now be described with reference to FIG. 6.

As in a typical cooling device, the immersion type ice making unit 300 forms a cooling cycle.

In detail, as shown in FIG. 6, the immersion type ice making unit 300 includes a condenser 312 receiving high-temperature, high-pressure gas generated by the operation of a compressor 311 of a cooling (freezing) cycle, and condensing the gas into a medium-temperature, high-pressure liquid refrigerant through heat-exchange; a capillary tube 313 changing the medium-temperature, high-pressure liquid refrigerant, heat-exchanged in the condenser 312, into a low-temperature, low-pressure liquid refrigerant; and the evaporator 120 circulating therein the low-temperature, low-pressure liquid refrigerant having passed through the capillary tube 313. Here, the immersion pipes 121, connected to the evaporator 120 and immersed in raw water in the water tray member 200, rapidly drops the temperature of the raw water received in the water tray member 200. Accordingly, ice is formed around the immersion pipes 121

In this state, the immersion type ice making unit 300 is driven for a predetermined duration, such that ice with predetermined size is formed around the immersion pipe 121. Then, the driving of the compressor 311 and the like is terminated by the control unit (not shown), thereby completing the ice making process of the ice making unit 300.

After the ice making process is completed, the water tray member 200 is rotated and placed at a location enabling the ice to be separated (hereinafter ice separating location) such that the ice, separated from the immersion pipes 121 of the evaporator 120, can be dropped into the ice storage unit 140 (see FIG. 7E). In a state where the water tray member 200 has rotated to the ice separating location, a high-temperature, high-pressure refrigerant gas (hot gas) for the separation of ice is introduced into the evaporator 120 of the immersion type ice making unit 300 through an ice separating line 315 by a solenoid valve 316, thereby rapidly separating ice from the immersion pipes 121 of the evaporator 120. Thus, ice hanging around the immersion pipes 121 of the evaporator 121 is dropped and loaded in the ice storage unit 140 or the water cooler tank 130.

FIG. 6 illustrates the ice making unit 300 in which the high-temperature, high-pressure refrigerant gas (hot gas) is introduced to the immersion pipes 121 of the evaporator 120 through the solenoid valve for the separation of ice. However, a heater (not shown) for the separation of ice (hereinafter ice separating heater) connected to the evaporator 120 or the immersion pipes 121, may be provided separately from the ice making unit 30 in order to serve to separate ice from the immersion pipes 121 using heat generated therefrom.

After the separation of ice is completed, the solenoid valve is shut down, and the water tray member 200 then returns to a location allowing for the ice-making (hereinafter, ice making location) as depicted in FIG. 7A, thereby preparing for an ice making process.

As described, above, the ice making unit 300 supplies a low-temperature refrigerant to the evaporator 120, and forms ice I around the immersion pipes 121. To separate the ice I from the immersion pipe 121, the ice making unit 300 supplies a high-temperature refrigerant (hot gas) to the immersion pipes 121 of the evaporator 120, or the ice separating heater heats the evaporator 120 or the immersion pipes 121.

Hereinafter, the heating unit that heats raw water received in the water tray member 200, and the control unit (not shown) that controls the operation of the heating unit and/or the ice making unit 300 will now be described in detail.

The control unit controls the operation of the heating unit such that raw water in the water tray member 200 is heated before the ice-making unit 300 cools the raw water received in the water tray member 200.

That is, the related art ice maker is disadvantageous in that when raw water received in a water tray member is low in temperature, ice momentarily grows around immersion pipes at the initial stage of an ice making process, and air bubbles are introduced and trapped in the ice to thereby form an opaque layer. In order to prevent this from occurring, the control unit, according to this embodiment, raises the temperature of the raw water to a predetermined extent before the ice making process. Accordingly, the ice maker 100 is capable of preventing ice containing air bubbles therein from being grown around the immersion pipes 121 at the initial stage of the ice making process, and thus of preventing an opaque layer from being formed in the ice around the immersion pipes 121.

Notably, as described above, the temperature of raw water is lowered (e.g., to a temperature of less than 5° C.) when raw water, remaining in the water tray member 200 after the termination of the ice making process, is repetitively re-used in subsequent ice making processes or when cold raw water is supplied from the water cooler tank 139. When this occurs, opaque ice may be rapidly formed around the immersion pipes 121. However, according to this embodiment, by raising the temperature of raw water, an opaque layer can be prevented from being formed at the center of ice.

In order to raise the temperature of the raw water to a predetermined extent, the heating unit is used, and the control unit controls the operation of the heating unit such that the temperature of the raw water is raised before the ice making process.

The heating unit may be, for example, provided integrally in the ice making unit 300, and include the solenoid valve 316 supplying a high temperature refrigerant generated by the compressor 311 to the evaporator 120 and the immersion pipes 121. The heating unit may use, for example, a configuration that supplies a high temperature refrigerant (hot gas) to the evaporator 120 for a predetermined duration (e.g., 30 seconds to 90 seconds) in order to raise the temperature of the ice-making raw temperature by a predetermined extent. When the ice making unit 300 and the heating unit are formed integrally as described above, the raw water can be heated with a simple structure.

Alternatively, the heating unit may include a heater (not shown) provided separately from the ice making unit 300. The heater (not shown) may be, for example, an ice-separating heater that heats the immersion pipes 121 or the evaporator 120. In this case, the heated immersion pipes 121 are immersed in raw water received in the water tray member 200, so that the temperature of the raw water can be raised. Alternatively, the heating unit may be an immersion type heater that is immersed directly in raw water received in the water tray member 200 to thereby increase the temperature of the raw water.

As described above, raw water in the water tray member 200 may be heated by immersing the immersion type heater or the immersion pipe 121 heated by the high-temperature refrigerant or the ice separating heater in the raw water raw water for ice-making. In this case, the raw water comes in direct contact with the heating unit and is thus heated, thereby enhancing heating efficiency.

Notably, heating the water tray member 200 directly may be time-consuming and fail in sufficient heat transfer up to the center of the water tray member 200. Even if the heating is carried out, the raw water may have a lower temperature at a portion in which the immersion pipes 121 are immersed than at a portion adjacent to the inner surface of the water tray member 200, thereby failing to sufficiently heat the raw water. However, according to this embodiment, the heated immersion pipes 121 or the separate immersion type heater is immersed in raw water, so that the raw water can be increased in temperature quickly and sufficiently.

The raw water heated by the heating unit needs to be raised to a set temperature or higher.

For example, the set temperature may range from 6° C. to 25° C. A set temperature exceeding 25° C. increases a temperature difference from a room temperature, and thus requires much time and a large amount of heat. In contrast, when the set temperature is less than 6° C., there is no difference from not heating the raw water, considering the temperature of the water cooler tank (typically 4° C.).

The set temperature may preferably range from 10° C. to 15° C. The set temperature of 10° C. or higher hardly forms ice rapidly around the immersion pipe 121, and thus air bubbles are not trapped in the center of the ice. In addition, the set temperature of 15° C. or lower may reduce the amount of heat required for both heating and ice formation, thereby increasing energy efficiency.

As shown in FIG. 5, the ice maker, according to this embodiment, may include a temperature sensor S measuring the temperature of raw water received in the water tray member 200. The temperature sensor S allows for more precise control since the supply of the high-temperature refrigerant (hot gas) to the evaporator 120, or the operation of the separately provided ice separating heater or immersion type heater can be controlled on the basis of a temperature detected by the temperature sensor S.

The configuration of the movement generation unit 160 will now be described with reference to FIGS. 2 through 5.

As shown in FIGS. 2 through 5, the movement generation unit 160 generates a movement of the raw water received in the water tray member 200.

In detail, the movement generation unit 160 may include a wave generation plate 161 immersed in the raw water in the water tray member 200 (ice-making water tray 210) and swiveling within a predetermined angular range, a permanent magnet 164 installed at one side of the wave generation plate 161, and an electromagnet 166 periodically applying an attractive force or a repulsive force to the permanent magnet 164.

Here, the elements of the movement generation unit 160 other than the wave generation plate 161 and a shaft member 162 serving as the swivel axis of the wave generation plate 161 are installed outside the water tray member 200. In detail, the permanent magnet 164 is mounted at the lower end of a fixing member 163 fixed to one side of the shaft member 162 so as to swivel together with the wave generation plate 161.

As shown in FIG. 5, the electromagnet 166 is also installed outside the water tray member 200. Here, the electromagnet 166 applies an attractive force or a repulsive force to the permanent magnet 164 through a magnetic-force transfer part 167. Notably, the installation structure of the movement generation unit 160 is simplified since the electromagnet 166 is mounted on a body housing (not shown) of the ice maker 100, and is not directly connected with the water tray member 200. Furthermore, since the elements of the movement generation unit 161 other than the wave generation plate 161 are installed outside the water tray member 200, ice is prevented from being contaminated or degraded in cleanliness due to rust (corrosion) occurring on the permanent magnet 164.

However, the configuration of the movement generation unit 160, according to this embodiment, is not limited to that illustrated in FIGS. 2 through 5, provided that it can generate a movement of the raw water received in the water tray member 200. For example, the movement generation unit 160 may be configured such that it rotates the water tray member 200 within a predetermined angular range, or is mounted on the inner surface or the inside of the water tray member 200 and vibrates raw water.

As described above, since the movement generation unit 160 moves the raw water during the ice making process, air bubbles are prevented from being introduced and trapped in ice, so that wholly transparent (clear) ice can be produced.

Hereinafter, a method of controlling an ice maker, according to an exemplary embodiment of the present invention, will now be described with reference to FIGS. 7A through 8. For ease of description, the ice maker 100 depicted in FIGS. 1 through 5 is described in this embodiment, but the method of controlling an ice maker according to the present invention is not limited to this illustrated ice maker.

Referring to FIGS. 7A through 8, the method of controlling an ice maker, involves a method of controlling the ice maker 100 that produces ice by cooling raw water received in the water tray member 200. In greater detail, the method of controlling an ice maker relates to a method of driving the immersion type ice making unit 300 that has the immersion pipes 121 in the evaporator 120 immersed in raw water received in the water tray member 200, and thus forms ice around the immersion pipes 121.

First, an ice making process is required when the amount of ice stored in the ice storage unit 140 is small or the temperature of cold water is high. In such a manner, it is determined whether the ice making process is required in operation S10. When the ice making process is required, raw water for ice-making (hereinafter raw water) is supplied to the water tray member 200 in operation S20. When the water tray member 200 includes the ice-making water tray 210 and the auxiliary water tray 220 as shown in FIGS. 1 through 3, the raw-water supplying operation S20 may be performed by providing the ice-making water tray 210 with raw water remaining in the auxiliary water tray 220 after a previous ice separating operation (S50) and newly provided raw water from the purified water tank 110 or the water cooler tank 120. However, if the water tray member 200 includes only one water tray, the raw-water supplying operation S20 may be performed by filling the water tray member 200 with only newly provided raw water from the purified water tank 110 or the water cooler tank 120.

Thereafter, a temperature raising operation is performed in operation S30. In the temperature raising operation S30, the temperature of the raw water received in the water tray member 200 is raised so as to prevent rapid ice formation around the immersion pipes 121 and thus allow for the production of clear ice.

The temperature raising operation S30 may be performed simultaneously during or after the raw-water supplying operation S20. Notably, if the temperature raising operation S30 and the raw-water supplying operation S20 are performed at the same time, the remaining heat of the immersion pipes 121, heated by a high-temperature refrigerant or a separate ice-making heater in a previous ice separating operation, is usable as a part of heat source for heating raw water. Accordingly, energy consumption for heating can be reduced.

In the temperature raising operation S30, as shown in FIG. 7A, a high-temperature refrigerant (hot gas) is supplied to the evaporator 120 for a predetermined duration (e.g., 30 seconds to 90 seconds) to thereby raise the temperature of raw water. Alternatively, the temperature of the raw water in the water tray member 200 (ice-making water tray 210) may be raised by using, for example, the immersion type heater (not shown) provided separately from the ice making unit 300 and immersed in raw water, or the ice separating heater (not shown) contacting the immersion pipes 121 or the evaporator 120 and heating the immersion pipes 121. By heating the raw water for a predetermined duration as described above, the temperature raising process can be simply implemented.

In particular, when raw water in the water tray member 200 is heated by immersing the heated immersion pipe 121 or the separate immersion type heater in the raw water received in the watery tray member 200, the heating is conducted in direct contact between the heating unit and the raw water, thereby enhancing heating efficiency. Furthermore, a portion of the raw water in which the heated immersion pipe 121 or the immersion type heater is immersed can be heated quickly and sufficiently.

As shown in FIG. 7A, the temperature sensor S measuring the temperature of the raw water may be provided. In this case, the temperature of the raw water can be controlled on the basis of a temperature value measured by the temperature measuring sensor S.

In detail, as shown in FIG. 8, the temperature of the raw water is measured using the temperature sensor S in operation S31, and the temperature of the raw water is compared with a preset temperature in operation S32. When the temperature of the raw water is higher than the preset temperature, an ice making process is performed in operation S40. However, when the temperature of the raw water is lower than the preset temperature, the raw water is heated in operation S33 as described above in order to prevent an opaque ice layer from being formed around the immersion pipe 121.

At this time, the raw water, heated by the heating unit such as the separate immersion type heater or the immersion pipe 121 heated by a high-temperature refrigerant or an ice separating heater, needs to be heated to a predetermined set temperature or higher.

For example, the set temperature may range from 6° C. to 25° C. Here, the set temperature exceeding 25° C. may require a long heating time and a large amount of heat due to a large difference from room temperature. In contrast, when the set temperature is less than 6° C., there is no difference from not heating the raw water, considering the temperature of the water cooler tank (typically 4° C.).

The set temperature may preferably range from 10° C. to 15° C. The set temperature of 10° C. or higher hardly forms ice rapidly around the immersion pipe 121, and thus prevents air bubbles from being trapped in the central portion of ice. In contrast, the set temperature of 15° C. or less may maintain the balance of the amount of heat consumed for heating and ice formation, thereby enhancing energy efficiency.

Subsequently, as shown in FIG. 7B, the ice making operation is performed in operation S40. In the ice making operation S40, ice is formed around the immersion pipe 121 of the evaporator 120 while the immersion pipe 121 is immersed in the raw water in the water tray member 200. The ice making operation S40 is conducted by supplying a low-temperature refrigerant to the evaporator 120.

The ice making operation S40 may include moving the raw water in the water tray member 200 so as not to cause air bubbles contained in the raw water to be trapped in ice and render the ice opaque. This raw-water moving operation may be conducted by using the movement generation unit 160 as shown in FIG. 7B.

As described above, the movement generation unit 160 may be operated by swiveling the wave generation plate 161 (see FIG. 5) immersed in the raw water in the water tray member 200. Also, the wave generation plate 161 may be swiveled by an attractive force and a repulsive force periodically generated between the permanent magnet 164 and the electromagnet 166.

However, this movement generation unit 160 is not limited to the construction including the wave generation plate 161. The movement generation unit 160 may perform its function by rotating the water tray member 200 about a water-tray rotary shaft 211 within a small angular range, or by vibrating the raw water in the water tray member 200.

As described above, the temperature of the raw water is raised at the initial stage of ice making process and thus air bubbles are prevented from being trapped in ice. This allows for the production of clear ice.

Subsequently, when ice is formed into a predetermined size, the ice making process is completed in operation S45, and an ice separation process is performed in operation S50.

Figure 7C:
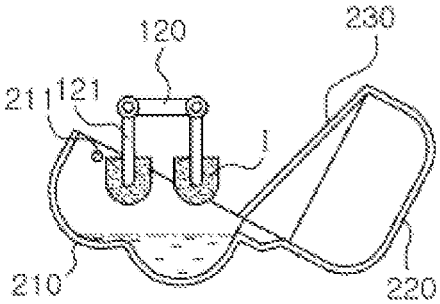

In detail, when the ice making process (i.e., ice producing operation) is completed, as shown in FIG. 7C, the water tray member 200 is rotated clockwise about the water-tray rotary shaft 211 by a water-tray rotating unit (not shown) such as a motor.

Figure 7D:
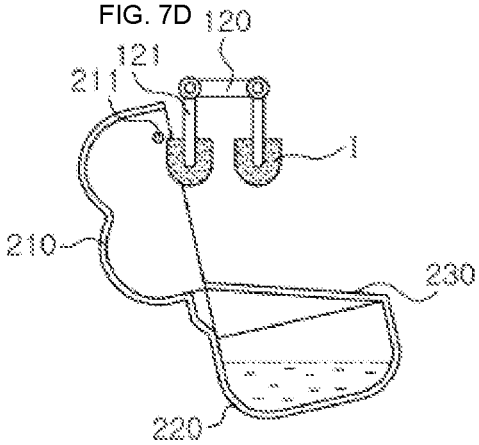

When the water tray member 200 is rotated further as shown in FIG. 7D, the raw water remaining in the ice-making water tray 210 fully flows toward and is received in the auxiliary water tray 220 through a water inlet 231 of the guide grill 230

Figure 7E:
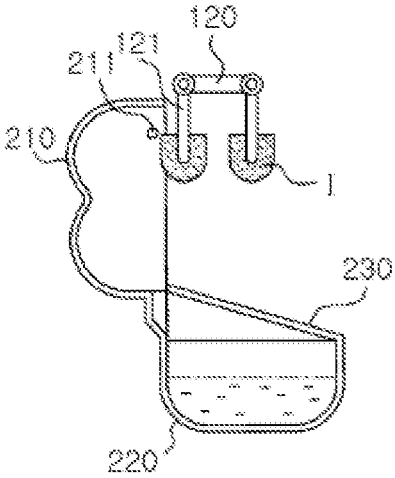
Figure 7F:
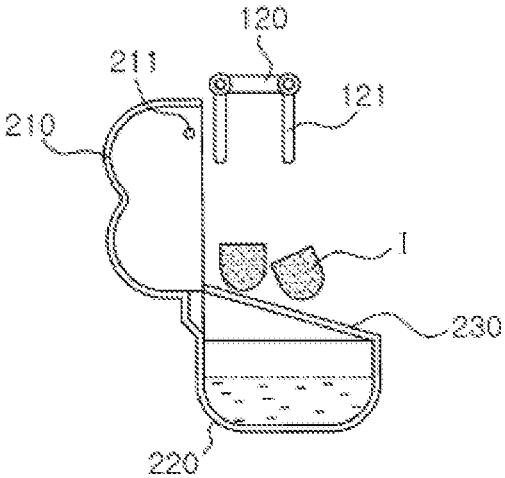

FIG. 7E illustrates the water tray member 200 fully rotated to the ice separating location. As shown in FIG. 7F, while the water tray member 200 stays at this ice separating location, a high-temperature refrigerant (hot gas) is supplied to the immersion pipes 121 of the evaporator 120, and thus ice is separated from the immersion pipes 121 by the heat of the refrigerant. Alternatively, the ice separating operation may be performed by using the separate ice separating heater that heats the immersion pipes 121. The separated ice falls along the surface of the inclined guide grill 230, and moves to the ice storing unit 140 or the water cooler tank 130 according to the location of the guide member 150. In detail, the ice moves to the ice storing unit 140 when the guide member 150 is placed at location A of FIG. 2, and moves to the water cooler tank 130 when the guide member 150 is placed at location B of FIG. 2.

Thereafter, the water tray member 200 returns to the ice making location illustrated in FIG. 7A for the next ice making operation. In this returning process, the cold raw water remaining in the auxiliary water tray 220 returns to the ice-making water tray 210 through the water inlet 231 of the guide 230. At this time, additional water supply is carried out from the water cooler tank 130 or the purified water tank 110 in order to supplement insufficient raw water for ice-making.

The temperature raising operation S30 and the ice making operation S40 may be performed at room temperature in order to prevent ice from being formed rapidly around the immersion pipes 121.

While the present invention has been shown and described in connection with the exemplary embodiments, it will be apparent to those skilled in the art that modifications and variations can be made without departing from the spirit and scope of the invention as defined by the appended claims.

What is claimed is:

1. An ice maker comprising:

a water tray member configured to receive raw water for ice-making from a water tank;

an ice making unit configured to cool the raw water received in the water tray member and form ice;

a heating unit configured to heat the raw water received in the water tray member; and a control unit configured to control the heating unit such that the raw water received in the water tray member is heated, wherein the control unit controls the ice making unit to start cooling the raw water received in the water tray member after the control unit controls the heating unit to terminate heating the raw water.

2. The ice maker of claim 1, wherein the heating unit includes a heater provided separately from the ice making unit and heats the raw water received in the water tray member.

3. The ice maker of claim 1, further comprising a movement generation unit configured to generate a movement of the raw water received in the water tray member.

4. The ice maker of claim 3, wherein the movement generation unit includes a wave generation plate immersed in the raw water in the water tray member and the wave generation plate is configured to swivel within a predetermined angular range.

5. The ice maker of claim 4, wherein the movement generation unit further includes:

a permanent magnet installed at one side of the wave generation plate; and an electromagnet which periodically applies an attractive force or a repulsive force to the permanent magnet.

6. The ice maker of claim 5, wherein the permanent magnet is installed outside the water tray member and is fixed to a fixing member which swivels together with the wave generation plate.

7. The ice maker of claim 1, wherein the ice making unit includes an evaporator having an immersion pipe immersed in the raw water received in the water tray member, the ice making unit further configured to supply a low-temperature refrigerant to the evaporator so as to form ice around the immersion pipe, the heating unit further configured to supply a high-temperature refrigerant to the evaporator so as to heat the raw water received in the water tray member, and the control unit further configured to control the heating unit such that a temperature of the raw water received in the water tray member is raised by supplying the high-temperature refrigerant to the evaporator before ice is formed around the immersion pipe.

8. The ice maker of claim 7, wherein the heating unit includes a solenoid valve configured to supply a high temperature refrigerant to the evaporator.

9. The ice maker of claim 1, wherein the water tray member includes:

an ice-making water tray configured to receive the raw water in which the immersion pipe is immersed during an ice making process; and an auxiliary water tray connected to the ice-making water tray configured to receive the raw water remaining in the ice-making water tray during an ice separating process.

* * * * *